US011608615B1

(12) United States Patent
Pintore et al.

(10) Patent No.: US 11,608,615 B1
(45) Date of Patent: Mar. 21, 2023

(54) SYSTEM AND METHOD FOR CONTROLLING HYDRAULIC VALVE OPERATION WITHIN A WORK VEHICLE

(71) Applicant: CNH Industrial America LLC, New Holland, PA (US)

(72) Inventors: Francesco Pintore, Modena (IT); Stefano Fiorati, Ferrara (IT); Andrea Vacca, West Lafayette, IN (US); Patrick Michael Joseph Stump, Ashland, KY (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/511,115

(22) Filed: Oct. 26, 2021

(51) Int. Cl.
*E02F 9/22* (2006.01)
*F15B 11/16* (2006.01)
*E02F 3/43* (2006.01)

(52) U.S. Cl.
CPC ..... *E02F 9/2267* (2013.01); *E02F 3/431* (2013.01); *E02F 9/2285* (2013.01); *E02F 9/2296* (2013.01); *F15B 11/165* (2013.01); *F15B 2211/253* (2013.01); *F15B 2211/6054* (2013.01); *F15B 2211/7128* (2013.01)

(58) Field of Classification Search
CPC ..... F15B 11/161; F15B 11/162; F15B 11/165; F15B 2211/6309; F15B 2211/6313; F15B 2211/634; F15B 2211/6346; E02F 9/2296
See application file for complete search history.

(56) References Cited

U.S. PATENT DOCUMENTS 4,967,557 A * 11/1990 Izumi ..... E02F 9/2228 60/449
5,134,853 A * 8/1992 Hirata ..... E02F 9/2225 91/518
5,452,579 A * 9/1995 Friedrichsen ..... F15B 11/165 91/1
6,173,573 B1 1/2001 Kamada
(Continued)

FOREIGN PATENT DOCUMENTS

CN 1190601 C 2/2005
CN 109058234 B 6/2020
(Continued)

*Primary Examiner* — Michael Leslie
(74) *Attorney, Agent, or Firm* — Rickard Demille; Rebecca Henkel

(57) ABSTRACT

A work vehicle a computing system configured to receive first and second input associated with controlling the operation of the first and second hydraulic load, respectively. Furthermore, the computing system is configured to control the operation of a first or second flow control valve corresponding to the one of the first or second hydraulic loads associated with the greater hydraulic fluid pressure such that the corresponding adjustable orifice is at a maximum flow position. Additionally, the computing system is configured to determine the first and second pressures of the hydraulic fluid being supplied to the first or second hydraulic loads. Moreover, the computing system is configured to control the operation of the first or second flow control valve corresponding to another of the first or second hydraulic loads based on the corresponding received first or second input and the determined first and second pressures.

20 Claims, 4 Drawing Sheets

(56) References Cited

U.S. PATENT DOCUMENTS

| | | | | |
|---|---|---|---|---|
| 7,043,907 | B2 | 5/2006 | Asano et al. | |
| 7,434,393 | B2 | 10/2008 | Hesse | |
| 9,200,646 | B2 | 12/2015 | Weickert et al. | |
| 9,506,465 | B2 * | 11/2016 | Dybing | B66F 9/22 |
| 10,024,342 | B2 * | 7/2018 | Terao | F15B 11/162 |
| 11,193,254 | B2 * | 12/2021 | Moriki | F15B 11/028 |
| 11,261,582 | B1 * | 3/2022 | Andreuccetti | E02F 9/2228 |
| 2021/0017776 | A1 | 1/2021 | Münzenmaier et al. | |

FOREIGN PATENT DOCUMENTS

| | | | |
|---|---|---|---|
| CN | 111577687 | A | 8/2020 |
| DE | 102012110978 | A1 | 5/2014 |
| DE | 102019208086 | A1 | 12/2020 |
| JP | 4985222 | B2 | 7/2012 |

* cited by examiner

SYSTEM AND METHOD FOR CONTROLLING HYDRAULIC VALVE OPERATION WITHIN A WORK VEHICLE

FIELD OF THE INVENTION

The present disclosure generally relates to work vehicles and, more particularly, to systems and methods for controlling the operation of hydraulic valves within a work vehicle.

BACKGROUND OF THE INVENTION

A work vehicle, such as a construction vehicle, an agricultural vehicle, or the like, generally includes a hydraulic system to actuate various components of the vehicle. For example, the hydraulic system may to raise and lower an implement, such as a bucket, at the operator's command. As such, the hydraulic system generally includes one or more hydraulic loads (e.g., hydraulic actuators, motors, and/or the like) and a pump configured to supply hydraulic fluid to the load(s)

Additionally, the hydraulic system may include various valves and other flow control devices to control the flow of the hydraulic fluid from the pump to the hydraulic load(s). For example, many hydraulic systems include a flow control valve having an adjustable orifice positioned upstream of each hydraulic load that controls the flow rate of the hydraulic fluid being delivered to the corresponding load(s). In this respect, each flow control valve controls the flow rate of the hydraulic fluid being supplied to the downstream load(s) based on the opening position or cross-sectional area of its orifice.

Furthermore, many hydraulic systems include a compensator valve positioned adjacent to each flow control valve. The compensator valve, in turn, maintains a predetermined pressure drop across the corresponding flow control valve regardless of the opening position of its orifice. However, in many instances, the compensator valve creates a greater than necessary pressure drop across the corresponding flow control valve. This results in a greater load on the pump, thereby increasing the energy consumption of the work vehicle and reducing its fuel economy.

Accordingly, an improved system and method for controlling hydraulic valve operation within a work vehicle would be welcomed in the technology. In particular, an improved system and method for controlling hydraulic valve operation within a work vehicle that reduces the energy consumption of the vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a work vehicle. The work vehicle includes a first hydraulic load, a second hydraulic load in parallel with the first hydraulic load, and a pump configured to supply hydraulic fluid to the first and second hydraulic loads via first and second fluid conduits, respectively. Furthermore, the work vehicle includes a first flow control valve defining an adjustable orifice, with the first flow control valve fluidly coupled to the first fluid conduit upstream of the first hydraulic load such that the first flow control valve is configured to control a flow rate of the hydraulic fluid to the first hydraulic load. Additionally, the work vehicle includes a second flow control valve defining an adjustable orifice, with the second flow control valve fluidly coupled to the second fluid conduit upstream of the second hydraulic load such that the second flow control valve is configured to control a flow rate of the hydraulic fluid to the second hydraulic load. Moreover, the work vehicle includes a first pressure sensor configured to capture data indicative of a first pressure of the hydraulic fluid being supplied to the first hydraulic load by the first flow control valve. In addition, the work vehicle includes a second pressure sensor configured to capture data indicative of a second pressure of the hydraulic fluid being supplied to the second hydraulic load by the second flow control valve and a computing system communicatively coupled to the first and second pressure sensors. In this respect, the computing system is configured to receive a first input associated with controlling an operation of the first hydraulic load and receive a second input associated with controlling an operation of the hydraulic fluid to be supplied to the second hydraulic load. Furthermore, the computing system is configured to determine one of the first or second hydraulic loads associated with a greater hydraulic fluid pressure based on the received first and second inputs. Additionally, the computing system is configured to control an operation of the first or second flow control valve corresponding to the one of the first or second hydraulic loads associated with the greater hydraulic fluid pressure such that the corresponding adjustable orifice has a maximum cross-sectional area corresponding to at a maximum flow position. Moreover, the computing system is configured to determine the first and second pressures of the hydraulic fluid being supplied to the first or second hydraulic loads based on the data captured by the first and second pressure sensors, respectively. In addition, the computing system is configured to control an operation of the first or second flow control valve corresponding to another of the first or second hydraulic loads based on the corresponding received first or second input and the determined first and second pressures.

In another aspect, the present subject matter is directed to a system for controlling hydraulic valve operation within a work vehicle. The system includes a first hydraulic load, a second hydraulic load in parallel with the first hydraulic load, and a pump configured to supply hydraulic fluid to the first and second hydraulic loads via first and second fluid conduits, respectively. Furthermore, the work vehicle includes a first flow control valve defining an adjustable orifice, with the first flow control valve fluidly coupled to the first fluid conduit upstream of the first hydraulic load such that the first flow control valve is configured to control a flow rate of the hydraulic fluid to the first hydraulic load. Additionally, the work vehicle includes a second flow control valve defining an adjustable orifice, with the second flow control valve fluidly coupled to the second fluid conduit upstream of the second hydraulic load such that the second flow control valve is configured to control a flow rate of the hydraulic fluid to the second hydraulic load. Moreover, the work vehicle includes a first pressure sensor configured to capture data indicative of a first pressure of the hydraulic fluid being supplied to the first hydraulic load by the first flow control valve. In addition, the work vehicle includes a second pressure sensor configured to capture data indicative of a second pressure of the hydraulic fluid being supplied to the second hydraulic load by the second flow control valve and a computing system communicatively coupled to the first and second pressure sensors. In this respect, the computing system is configured to receive a first input associated with controlling an operation of the first hydraulic load and receive a second input associated with controlling an operation of the hydraulic fluid to be supplied to the second hydraulic load. Furthermore, the computing system is configured to determine one of the first or second hydraulic loads associated with a greater hydraulic fluid pressure based on the received first and second inputs. Additionally, the computing system is configured to control an operation of the first or second flow control valve corresponding to the one of the first or second hydraulic loads associated with the greater hydraulic fluid pressure such that the corresponding adjustable orifice has a maximum cross-sectional area corresponding to at a maximum flow position. Moreover, the computing system is configured to determine the first and second pressures of the hydraulic fluid being supplied to the first or second hydraulic loads based on the data captured by the first and second pressure sensors, respectively. In addition, the computing system is configured to control an operation of the first or second flow control valve corresponding to another of the first or second hydraulic loads based on the corresponding received first or second input and the determined first and second pressures.

In a further aspect, the present subject matter is directed to a method for controlling hydraulic valve operation within a work vehicle. The work vehicle, in turn, includes first and second hydraulic loads in parallel, a pump configured to supply hydraulic fluid to the first and second hydraulic loads, respectively. Furthermore, the work vehicle further including a first flow control valve configured to control a flow rate of the hydraulic fluid to the first hydraulic load and a second flow control valve configured to control a flow rate of the hydraulic fluid to the second hydraulic load. The method includes receiving, with a computing system, a first input associated with controlling an operation of the first hydraulic load and receiving, with the computing system, a second input associated with controlling an operation of the second hydraulic load. Additionally, the method includes determining, with the computing system, one of the first or second hydraulic loads associated with a greater hydraulic fluid pressure based on the received first and second inputs. Moreover, the method includes controlling, with the computing system, an operation of the first or second flow control valve corresponding to the one of the first or second hydraulic loads associated with the greater hydraulic fluid pressure such that the corresponding adjustable orifice has a maximum cross-sectional area corresponding to at a maximum flow position. In addition, the method includes receiving, with the computing system, first pressure sensor data indicative of a first pressure of the hydraulic fluid being supplied to the first hydraulic load by the first flow control valve. Furthermore, the method includes receiving, with the computing system, second pressure sensor data indicative of a second pressure of the hydraulic fluid being supplied to the second hydraulic load by the second flow control valve. Additionally, the method includes determining, with the computing system, the first and second pressures of the hydraulic fluid being supplied to the first or second hydraulic loads based on the received first and second pressure sensor data, respectively. Moreover, the method includes controlling, with the computing system, an operation of the first or second flow control valve corresponding to the other of the first or second hydraulic loads based on the corresponding received first or second input and the determined first and second pressures.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
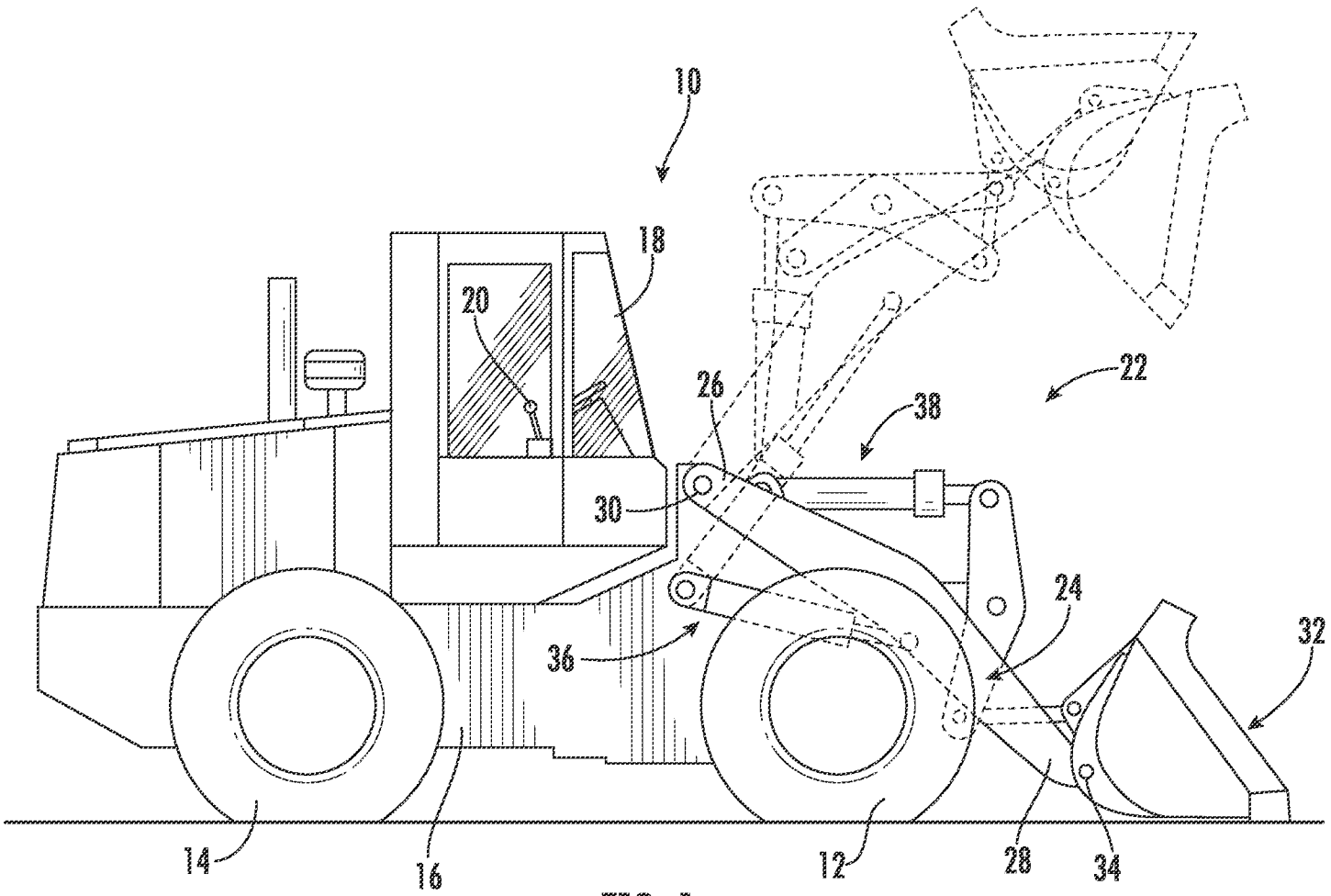
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system and method for controlling hydraulic valve operation within a work vehicle. As will be described below, the work vehicle includes first and second hydraulic loads (e.g., hydraulic cylinders) in parallel with each other. Furthermore, the work vehicle includes a pump configured to supply hydraulic fluid to the first and second hydraulic loads via first and second fluid conduits, respectively. Additionally, the work vehicle includes a first flow control valve fluidly coupled to the first fluid conduit upstream of the first hydraulic load such that the first flow control valve is configured to control the flow rate of the hydraulic fluid to the first hydraulic load. Moreover, the work vehicle includes a second flow control valve fluidly coupled to the second fluid conduit upstream of the second hydraulic load such that the second flow control valve is configured to control the flow rate of the hydraulic fluid to the second hydraulic load. In addition, the work vehicle includes an electronically controlled actuator configured to control the operation of the pump.

In several embodiments, a computing system of the disclosed system is configured to control the operation of the first and second flow control valves. More specifically, the computing system may receive first and second inputs (e.g., from a user interface of the vehicle) associated with controlling the operation of the first and second hydraulic loads, respectively. Furthermore, the computing system may determine the first or second hydraulic load having the greater hydraulic fluid pressure based on the received first and second inputs. Additionally, the computing system may control the operation of the first or second flow control valve corresponding to the hydraulic load having the greater hydraulic fluid pressure such that its adjustable orifice is at the maximum flow position (e.g., its maximum cross-sectional area). Moreover, the computing system may determine the first and second pressures of the hydraulic fluid being supplied to the first or second hydraulic loads, respectively, based on received pressure sensor data. In this respect, the computing system may control the operation of the pump (e.g., via the electronically controlled actuator) based on the greater of the determined first and second pressures. In addition, the computing system may control the operation of the first or second flow control valve corresponding to the other hydraulic load based on the corresponding first or second input and the determined first and second pressures.

For example, in certain instances, the received first and second inputs may indicate that the first hydraulic load is to receive hydraulic fluid at a greater pressure than the second hydraulic load. In such instances, the computing system may control the operation of the first flow control valve its adjustable orifice is at the maximum flow position. That is, the position of the adjustable orifice of the first flow control valve may have its maximum cross-sectional area regardless of the first input. Furthermore, in such instances, the computing system may determine the first and second pressures of the hydraulic fluid being supplied to the first and second hydraulic loads. Thereafter, the computing system may control the operation of the pump based on the determined first pressure and the operation of the second flow control valve based on the received second input and the first and second pressures.

The disclosed system and method improve the operation of the work vehicle. More specifically, as described above, the flow control valve corresponding to the hydraulic load having the greater fluid pressure is opened to its maximum flow position. Additionally, the other flow control valve is controlled based on the corresponding received input and the pressures of the fluid being supplied the first and second hydraulic loads. This allows the pump to discharge the hydraulic fluid at the minimum necessary pressure and the flow control valves to supply the desired flow of hydraulic fluid to each hydraulic load regardless of the pressure of the hydraulic fluid being discharged by the pump and without the need for compensator valves. Thus, the disclosed system and method allows for the removal of the compensator valves from the work vehicle, thereby reducing the load on the pump and improving the efficiency and fuel economy of the vehicle.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other construction vehicle (e.g., another type of loader, a dozer, a grader, etc.), an agricultural vehicle (e.g., a tractor, a harvester, a sprayer, etc.), or the like.

As shown in FIG. 1, the work vehicle 10 includes a pair of front wheels 12, a pair or rear wheels 14, and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10. For instance, as shown in FIG. 1, the work vehicle 10 includes one or more joysticks or control levers 20 for controlling the operation of one or more components of a lift assembly 22 of the work vehicle 10.

As shown in FIG. 1, the lift assembly 22 includes a pair of loader arms 24 (one of which is shown) extending lengthwise between a first end 26 and a second end 28. In this respect, the first ends 26 of the loader arms 24 may be pivotably coupled to the chassis 16 at pivot joints 30. Similarly, the second ends 28 of the loader arms 24 may be pivotably coupled to a suitable implement 32 of the work vehicle 10 (e.g., a bucket, fork, blade, and/or the like) at pivot joints 34. In addition, the lift assembly 22 also includes a plurality of hydraulic actuators for controlling the movement of the loader arms 24 and the implement 32. For instance, the lift assembly 22 may include a pair of hydraulic lift cylinders 36 (one of which is shown) coupled between the chassis 16 and the loader arms 24 for raising and lowering the loader arms 24 relative to the ground. Moreover, the lift assembly 22 may include a pair of hydraulic tilt cylinders 38 (one of which is shown) for tilting or pivoting the implement 32 relative to the loader arms 24.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration.

Figure 2:
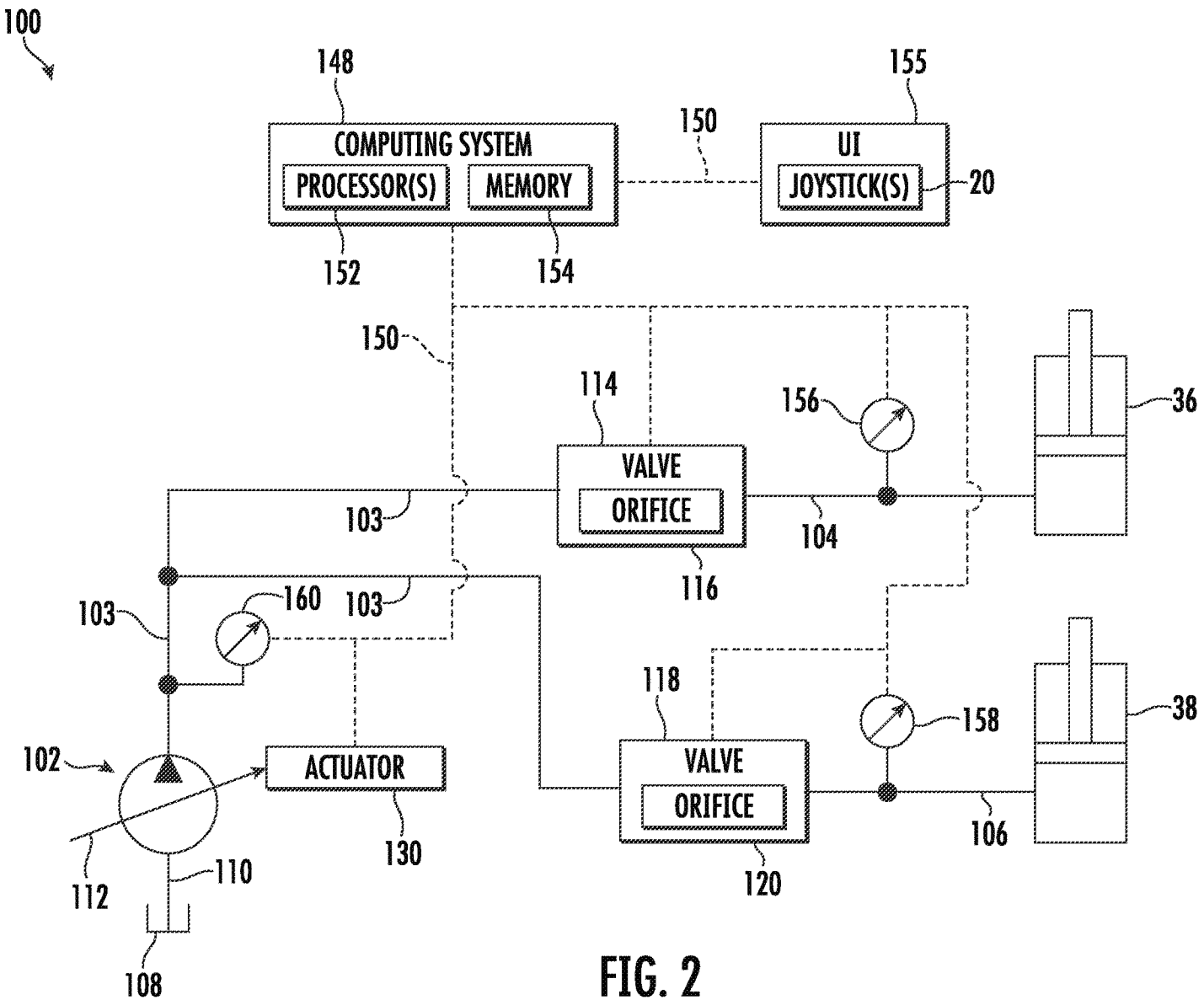
FIG. 2 illustrates a schematic view of one embodiment of a system for controlling hydraulic valve operation within a work vehicle in accordance with aspects of the present subject matter.

Referring now to FIG. 2, a schematic view of one embodiment of a system 100 for controlling hydraulic valve operation within a work vehicle is illustrated in accordance with aspects of the present subject matter. In general, the system 100 will be described herein with reference to the work vehicle 10 described above with reference to FIG. 1. However, it should be appreciated by those of ordinary skill in the art that the disclosed system 100 may generally be utilized with work vehicles having any other suitable vehicle configuration. For purposes of illustration, hydraulic connections between components of the system 100 are shown in solid lines while electrical connection between components of the system 100 are shown in dashed lines.

In several embodiments, as shown in FIG. 2, the system 100 includes a plurality of hydraulic loads of the work vehicle 10 (or an associated implement). In this respect, as will be described below, the system 100 may be configured to regulate or otherwise control the hydraulic fluid flow within the work vehicle 10 such that the hydraulic fluid is supplied to the hydraulic loads in a manner that reduces the energy consumption of the vehicle 10. For example, in the illustrated embodiment, the system 100 includes the lift cylinders 36 and the tilt cylinders 38 of the work vehicle 10. As shown, the lift cylinders 36 are in parallel with the tilt cylinders 38. However, the hydraulic loads may correspond to any suitable fluid-powered devices on the work vehicle 10 (or an associated implement), such as other hydraulic cylinders, hydraulic motors, and/or the like. Moreover, the system 100 may include any other suitable number of hydraulic loads, such as three or more hydraulic loads.

Furthermore, the system 100 may include a pump 102 configured to supply hydraulic fluid to the hydraulic loads of the vehicle 10 (or an associated implement) via a fluid supply conduit 103. In addition, the system 100 includes first and second fluid conduits 104, 106 fluidly coupled between the fluid supply conduit 103 and the hydraulic loads. Specifically, in several embodiments, the pump 102 may be configured to supply hydraulic fluid to the lift cylinders 36 of the vehicle 10 via the fluid supply conduit 103 and the first fluid conduit 104. Moreover, in several embodiments, the pump 102 may be configured to supply hydraulic fluid to the tilt cylinders 38 of the vehicle 10 via the fluid supply conduit 103 and the second fluid conduit 106. However, in alternative embodiments, the pump 102 may be configured to supply hydraulic fluid to any other suitable hydraulic loads of the vehicle 10 (or an associated implement). Additionally, the pump 102 may be in fluid communication with a fluid tank or reservoir 108 via a pump conduit 110 to allow hydraulic fluid stored within the reservoir 108 to be pressurized and supplied to the cylinders 36, 38.

In several embodiments, the pump 102 may be a variable displacement pump configured to discharge hydraulic fluid across a given pressure range. Specifically, the pump 102 may supply pressurized hydraulic fluid within a range bounded by a minimum pressure and a maximum pressure capability of the variable displacement pump. In this respect, a swash plash plate 112 may be configured to be controlled (e.g., via an electronically controlled actuator 130) to adjust the position of the swash plate 112 of the pump 102, as necessary, based on the load applied to the hydraulic system of the vehicle 10. However, in other embodiments, the pump 102 may correspond to any other suitable pressurized fluid source. Moreover, the operation of the pump 102 may be controlled in any other suitable manner.

Furthermore, the system 100 may include a plurality of flow control valves. In general, the flow control valves may be fluidly coupled to the fluid supply conduits upstream of the corresponding hydraulic load(s) such that the flow control valves are configured to control the flow rate of the hydraulic fluid to the loads. Specifically, in several embodiments, the system 100 may include a first flow control valve 114 fluidly coupled to a downstream end of one branch of the fluid supply conduit 103 and to an upstream end of the first fluid conduit 104. Thus, the first flow control valve 114 is fluidly coupled between the fluid supply conduit 103 and the first fluid conduit 104. Additionally, the first flow control valve 114 is upstream of the lift cylinders 36. As shown, the first flow control valve 114 may define an adjustable orifice 116. In this respect, by adjusting the opening position or the cross-sectional area of the orifice 116, the first flow control valve 114 can control the flow rate of the hydraulic fluid supplied to the lift cylinders 36. Moreover, in such embodiments, the system 100 may include a second flow control valve 118 fluidly coupled to a downstream end of another branch of the fluid supply conduit 103 and to an upstream end of the second fluid conduit 106. Thus, the second flow control valve 118 is fluidly coupled between the fluid supply conduit 103 and the second fluid conduit 106. In addition, the second flow control valve 118 is upstream of the tilt cylinders 38. As shown, the second flow control valve 118 may define an adjustable orifice 120. In this respect, by adjusting the opening position or the cross-sectional area of the orifice 120, the second flow control valve 118 can control the flow rate of the hydraulic fluid supplied to the tilt cylinders 38.

The first and second flow control valves 114, 118 may be configured as any suitable valves defining adjustable orifices. For example, in one embodiment, first and second flow control valves 114, 118 may be proportional directional valves. Such valves 114, 118 may include actuators (e.g., solenoid actuators) configured to adjust the cross-sectional areas of the orifices 116, 120 in response to receiving control signals (e.g., electric current) from a computing system 148. As such, the actuators may be configured to adjust the cross-sectional area of the orifices 116, 120 between a minimum flow position and a maximum flow position. When at the minimum flow position, the orifices 116, 120 may have their smallest cross-sectional areas (or, in some instances, may be closed). Conversely, when at the maximum flow position, the orifices 116, 120 may have their largest cross-sectional areas. In general, as the cross-sectional areas of the orifices 116, 120 increase, the pressure of hydraulic fluid needed to provide a selected flow rate to the lift and tilt cylinders 36, 38 may decrease.

Additionally, the system 100 may include an electronically controlled actuator 130. In general, the electronically controlled actuator 130 may be configured to control the controlling the operation of the pump 102 based on control signals received from a computing system 148. More specifically, the electronically controlled actuator 130 may be coupled to the swash plate 112. As such, the electronically controlled actuator 130 is configured to move the swash plate 112 based on the received control signals, thereby varying the pressure of the hydraulic fluid being discharged by the pump 102. When the load applied to the hydraulic system of the vehicle 10 decreases, the electronically controlled actuator 130 may move the swash plate 112 in manner that reduces the pressure of the hydraulic fluid being discharged by the pump 102. Conversely, when the load applied to the hydraulic system of the vehicle 10 increases, the electronically controlled actuator 130 may move the swash plate 112 in manner that increases the pressure of the hydraulic fluid being discharged by the pump 102. In this respect, the electronically controlled actuator 130 may correspond to any suitable type of actuator that can be electronically controlled by the computing system 148, such as a solenoid, an electric linear actuator, a stepper motor, or the like.

Furthermore, the system 100 may include a computing system 148 communicatively coupled to one or more components of the work vehicle 10 and/or the system 100 to allow the operation of such components to be electronically or automatically controlled by the computing system 148. For instance, the computing system 148 may be communicatively coupled to the first flow control valve 114 via a communicative link 150. As such, the computing system 148 may be configured to control the operation of the first flow control valve 114 to regulate the flow of the hydraulic fluid to the lift cylinders 36 such that the lift cylinders 36 raise and lower the loader arms 28 relative to the field surface. Furthermore, the computing system 148 may be communicatively coupled to the second flow control valve 118 via the communicative link 150. In this respect, the computing system 148 may be configured to control the operation of the second flow control valve 118 to regulate the flow of the hydraulic fluid to the tilt cylinders 38 such that the tilt cylinders 38 adjust the tilt of the implement 32. Additionally, the computing system 148 may be communicatively coupled to the electronically controlled actuator 130 via the communicative link 150. In this respect, the computing system 148 may be configured to control the operation of the pump 102 to regulate the pressure of the hydraulic fluid being discharged into the fluid supply conduit 103 by the pump 102. In alternative embodiments, the computing system 148 may be communicatively coupled to any other suitable valves, actuators, or other components of the system 100.

In general, the computing system 148 may comprise one or more processor-based devices, such as a given controller or computing device or any suitable combination of controllers or computing devices. Thus, in several embodiments, the computing system 148 may include one or more processor(s) 152 and associated memory device(s) 154 configured to perform a variety of computer-implemented functions. As used herein, the term "processor" refers not only to integrated circuits referred to in the art as being included in a computer, but also refers to a controller, a microcontroller, a microcomputer, a programmable logic circuit (PLC), an application specific integrated circuit, and other programmable circuits. Additionally, the memory device(s) 154 of the computing system 148 may generally comprise memory element(s) including, but not limited to, a computer readable medium (e.g., random access memory RAM)), a computer readable non-volatile medium (e.g., a flash memory), a floppy disk, a compact disk-read only memory (CD-ROM), a magneto-optical disk (MOD), a digital versatile disk (DVD) and/or other suitable memory elements. Such memory device(s) 154 may generally be configured to store suitable computer-readable instructions that, when implemented by the processor(s) 152, configure the computing system 148 to perform various computer-implemented functions, such as one or more aspects of the methods and algorithms that will be described herein. In addition, the computing system 148 may also include various other suitable components, such as a communications circuit or module, one or more input/output channels, a data/control bus and/or the like.

The various functions of the computing system 148 may be performed by a single processor-based device or may be distributed across any number of processor-based devices, in which instance such devices may be considered to form part of the computing system 148. For instance, the functions of the computing system 148 may be distributed across multiple application-specific controllers or computing devices, such as an implement controller, a navigation controller, an engine controller, and/or the like.

Furthermore, in some embodiment, the system 100 may also include a user interface 155. More specifically, the user interface 155 may be configured to receive inputs (e.g., inputs associated with controlling the operation of the lift and tilt cylinders 36, 38). As such, the user interface 155 may include one or more input devices, such as touchscreens, keypads, touchpads, knobs, buttons, sliders, switches, mice, microphones, and/or the like, which are configured to receive user inputs from the operator. For example, in one embodiment, the user interface 155 may include the joystick(s) 20. The user interface 155 may, in turn, be communicatively coupled to the computing system 148 via the communicative link 150 to permit the received inputs to be transmitted from the user interface 155 to the computing system 148. In addition, some embodiments of the user interface 155 may include one or more feedback devices (not shown), such as display screens, speakers, warning lights, and/or the like, which are configured to provide feedback from the computing system 148 to the operator. In one embodiment, the user interface 155 may be mounted or otherwise positioned within the cab 18 of the vehicle 10. However, in alternative embodiments, the user interface 155 may mounted at any other suitable location.

In several embodiments, the system 100 may include a plurality of pressure sensors configured to capture data indicative of the pressure of the hydraulic fluid at differing locations within the hydraulic system of the vehicle 10. Specifically, the system 100 includes a first pressure sensor 156 fluidly coupled to the first fluid conduit 104 downstream of the first flow control valve 114 and upstream of the lift cylinders 36. As such, the first pressure sensor 156 may be configured to capture data indicative of the pressure of the hydraulic fluid being supplied to the lift cylinders 36 by the first flow control valve 114. Furthermore, the system 100 includes a second pressure sensor 158 fluidly coupled to the second fluid conduit 106 downstream of the second flow control valve 118 and upstream of the tilt cylinders 38. In this respect, the second pressure sensor 158 may be configured to capture data indicative of the pressure of the hydraulic fluid being supplied to the tilt cylinders 38 by the second flow control valve 118. Moreover, the system 100 may include a third pressure sensor 160 fluidly coupled to the fluid supply conduit 103. Thus, the third pressure sensor 160 may be configured to capture data indicative of the pressure of the hydraulic fluid being discharged by the pump 102. As shown, the first, second, and third pressure sensors 156, 158, 160 may be communicatively coupled to the computing system 148 via the communicative link 150. As such, the computing system 148 may be configured to receive the captured data from the first, second, and third pressure sensors 156, 158, 160.

Figure 3:
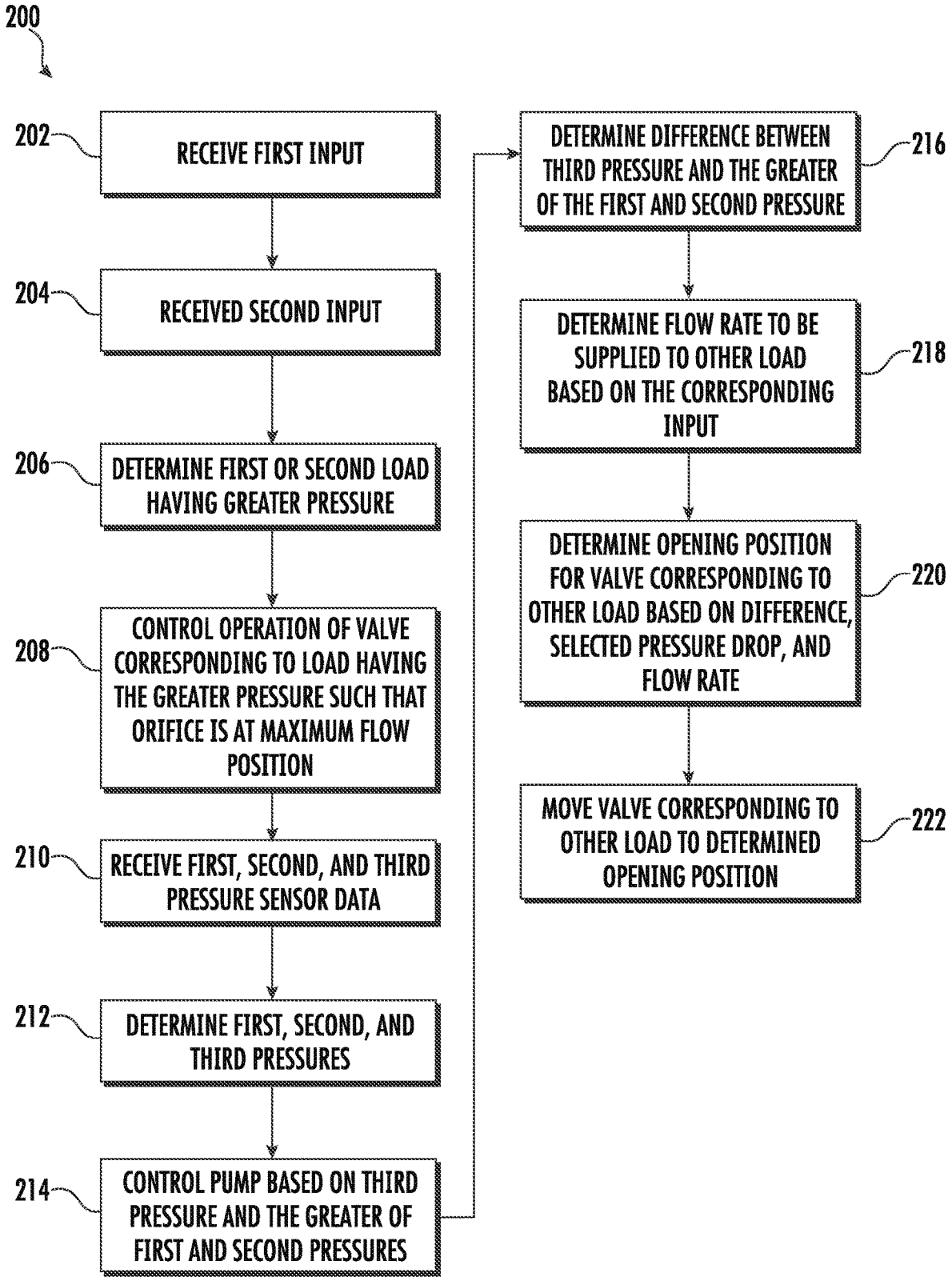
FIG. 3 illustrates a flow diagram providing one embodiment of example control logic for controlling hydraulic valve operation within a work vehicle in accordance with aspects of the present subject matter.

Referring now to FIG. 3, a flow diagram of one embodiment of example control logic 200 that may be executed by the computing system 148 (or any other suitable computing system) for controlling hydraulic valve operation within a work vehicle is illustrated in accordance with aspects of the present subject matter. Specifically, the control logic 200 shown in FIG. 3 is representative of steps of one embodiment of an algorithm that can be executed to control the operation of the hydraulic valves of a work vehicle in a manner that reduces the energy consumption of the vehicle. Moreover, the control logic 200 can be executed when the operation of the pump 102 is controlled via the electronically controlled actuator 130 based on captured data captured by the pressure sensors 156, 158, 160. Thus, in several embodiments, the control logic 200 may be advantageously utilized in association with a system installed on or forming part of a work vehicle having an electronically controlled pump to allow for real-time control of the operation of the hydraulic valves of the vehicle without requiring substantial computing resources and/or processing time. However, in other embodiments, the control logic 200 may be used in association with any other suitable system, application, and/or the like for controlling hydraulic valve operation within a work vehicle.

As shown in FIG. 6, at (202), the control logic 200 includes receiving a first input associated with controlling the operation of a first hydraulic load of the work vehicle 10 (or an associated implement). Specifically, as mentioned above, in several embodiments, the computing system 148 may be communicatively coupled to the user interface 155 via the communicative link 150. In this respect, the operator may provide a first input to the user interface 155. The first input may, in turn, be associated with controlling the operation of the lift cylinders 36. For example, in one embodiment, the operator may move one of the joysticks 20 a particular distance from its current position. Such distance may, in turn, be indicative of the operator's desired operation of the lift cylinders 36. Thereafter, the first input may be transmitted from the user interface 155 to the computing system 148 via the communicative link 150. Alternatively, the computing system 148 may receive the first input from any other suitable device, such as a remote computing device (e.g., a Smartphone, a remote database server, etc.) or a sensor.

Furthermore, at (204), the control logic 200 includes receiving a second input associated with controlling the operation of a second hydraulic load of the work vehicle 10. Specifically, in several embodiments, the operator may provide a second input to the user interface 155. The second input may, in turn, be associated with controlling the operation of the tilt cylinders 38. For example, in one embodiment, the operator may move one of the joysticks 20 a particular distance from its current position. Such distance may, in turn, be indicative of the operator's desired operation of the tilt cylinders 38. Thereafter, the second input may be transmitted from the user interface 155 to the computing system 148 via the communicative link 150. Alternatively, the computing system 148 may receive the second input from any other suitable device, such as a remote computing device (e.g., a Smartphone, a remote database server, etc.) or a sensor.

Additionally, at (206), the control logic 200 includes determining one of the first or second hydraulic loads associated with the greater hydraulic fluid pressure based on the received first and second inputs. More specifically, in many instances, the first and second inputs received at (202) and (204), respectively, may result in the hydraulic fluid being supplied to the lift cylinders 36 and the tilt cylinders 38 at different pressures. For example, when the operator moves the joystick 20 associated with the lift cylinders 36 farther than the joystick 20 associated with the tilt cylinders 38, the hydraulic fluid may be supplied to the lift cylinders 36 at a greater pressure than the tilt cylinders 38. Thus, in such an instance, the lift cylinders 36 are associated with the greater hydraulic fluid pressure. As such, in several embodiments, the computing system 148 may analyze the first input received at (202) and the second input received at (204) to determine which of the lift cylinders 36 or the tilt cylinders 38 will have or be associated with the greater hydraulic fluid pressure. As will be described below, the hydraulic load having the greatest pressure will be controlled differently than the hydraulic load(s) having the lesser pressure(s).

Moreover, at (208), the control logic 200 includes controlling the operation of the first or second flow control valve corresponding to the one of the first or second hydraulic loads associated with the greater hydraulic fluid pressure such that the corresponding adjustable orifice has a maximum cross-sectional area corresponding to at a maximum flow position. In several embodiments, the computing system 148 may control the operation of the first or second flow control valve 114, 118 corresponding to the lift cylinders 36 or the tilt cylinders having the greater hydraulic pressure therein as determined at (206) such that its adjustable orifice 116, 118 is moved to its maximum flow position (i.e., its maximum cross-sectional area). For example, when it is determined at (206) that the lift cylinders 38 are associated with the greater hydraulic pressure, the computing system 148 controls the operation of the first flow control valve 114 such that its orifice 116 is moved to its maximum flow position. Specifically, in such instances, the computing system 148 may transmit control signals to the first flow control valve 114 instructing the valve 114 to move its orifice 116 to its maximum flow position. This, in turn, reduces the pressure needed to supply the hydraulic fluid to the flow control valve 114, 118 corresponding to the hydraulic load associated with the greater hydraulic fluid pressure to achieve the flow rate associated with the corresponding first or second input.

In addition, at (210), the control logic 200 includes receiving first, second, and third pressure sensor data indicative of a first pressure of the hydraulic fluid being supplied to the first hydraulic load by the first flow control valve, a second pressure of the hydraulic fluid being supplied to the second hydraulic load by the second flow control valve, and a third pressure of the hydraulic fluid being discharged by the pump. Specifically, as mentioned above, in several embodiments, the computing system 148 may be communicatively coupled to the first, second, and third pressure sensors 156, 158, 160 via the communicative link 150. In this respect, during operation of the work vehicle 10, the computing system 148 may receive first, second, and third pressure data from the first, second, and third pressure sensors 156, 158, 160. The first pressure data may, in turn, be indicative of the pressure of the hydraulic fluid being supplied to the lift cylinders 36 by the first flow control valve 114. Moreover, the second pressure data may be indicative of the pressure of the hydraulic fluid being supplied to the tilt cylinders 38 by the second flow control valve 118. Additionally, the third pressure data may be indicative of the pressure of the hydraulic fluid being discharged into the fluid supply conduit 103 by the pump 102. In embodiments in which there are additional hydraulic loads, the computing system 148 may determine the pressure sensor data corresponding to those additional loads.

Furthermore, at (212), the control logic 200 includes determining the first, second, and third pressures of the hydraulic fluid being supplied to the first hydraulic load, the hydraulic fluid being supplied to the second hydraulic load, and the hydraulic fluid being discharged by the pump based on the received first, second, and third pressure sensor data, respectively. Specifically, in several embodiments, the computing system 148 may determine the first and second pressures of the hydraulic fluid being supplied to the of the lift cylinders 36 and the tilt cylinders 38 based on the first and second pressure sensor data received at (210). In addition, the computing system 148 may determine the pressure of the hydraulic fluid being discharged into the fluid supply conduit 103 by the pump 102 based on the third pressure sensor data received at (210). As will be described below, the first, second, and third pressure values determined at (212) are used when controlling the operation of the flow control valve 114, 118 corresponding to the lower pressure hydraulic load. Furthermore, in embodiments in which there are additional hydraulic loads, the computing system 148 may determine the pressure for the additional loads.

Moreover, at (214), the control logic 200 includes controlling the operation of a pump based on the determined third pressure and the greater of the determined first and second pressures. Specifically, in several embodiments, the computing system 148 may control the operation of the pump 102 based on the greater of the first and second pressures determined at (212). As such, the pump 102 may discharge hydraulic fluid at the minimum pressure sufficient to supply hydraulic fluid to the higher-pressure hydraulic load (e.g., the lift cylinders 36 or the tilt cylinders 38) at the flow rate associated with the corresponding first or second input. For example, the computing system 148 may transmit control signals to the electronically controlled actuator 130 via the communicative link 150. Such control signals, in turn, instruct the electronically controlled actuator 130 to adjust the position of the swash plate 112 such that the pump 102 discharges fluid at the minimum pressure sufficient to supply hydraulic fluid to the higher-pressure hydraulic load via the corresponding flow control valve 114, 118 (which is fully opened at (208)) at the flow rate associated with the corresponding first or second input.

As will be described below, the control logic 200 includes controlling the operation of the first or second flow control valve 114, 118 corresponding the other of the first or second hydraulic loads (i.e., the lower pressure hydraulic load).

Specifically, the operation of such valve 114, 118 is controlled based on the corresponding first or second input and the first and second pressures determined at (212). Moreover, in some embodiments, the operation of such valve 114, 118 may be controlled based on the third pressure determined at (212) and/or a selected pressure drop across the valve 114, 118 corresponding to the hydraulic load having the greater hydraulic fluid pressure in addition to the corresponding first or second input and the first and second pressures determined at (212). Additionally, in embodiments in which there are additional hydraulic loads, the computing system 148 may control the valves corresponding to the additional loads not having the greatest pressure in the same manner.

Furthermore, at (216), the control logic 200 includes determining a difference between the determined third pressure and the greater of determined first or second pressures. Specifically, in several embodiments, the computing system 148 may be configured to calculate the difference between the third pressure determined at (212) (i.e., the pressure of the hydraulic fluid being discharged by the pump 102) and the greater of the first or second pressures determined at (212) (i.e., the pressure of the hydraulic fluid being supplied to the hydraulic load having the higher pressure). For example, when it is determined at (206) that the lift cylinders 38 are associated with the greater hydraulic pressure, the computing system 148 determines the difference between the third pressure determined at (218) and the first pressure determined at (212). The difference determined at (216) is indicative of the pressure drop across the flow control valve 114, 118 corresponding the higher-pressure hydraulic load.

Additionally, at (218), the control logic 200 includes determining a flow rate of hydraulic fluid to be supplied to the other of the first or second hydraulic loads based on the corresponding received first or second input. Specifically, in several embodiments, the computing system 148 may determine the flow rate of the hydraulic fluid to be supplied to the of the lift cylinders 36 or the tilt cylinders 38 having the lower pressure therein based on the corresponding received first or second input. For example, when it is determined at (206) that the lift cylinders 38 are associated with the greater hydraulic pressure, the computing system 148 determines the flow rate of the hydraulic fluid to be supplied to the tilt cylinders 38 based on the second input received at (204). Specifically, in such instances, the computing system 148 may access a valve area map stored within its memory 154 for the second flow control valve 118. The valve area map may, in turn, be a look-up table or other suitable data structure that correlates second input received from the operator (e.g., the distance that the corresponding joystick 20 is moved) to the corresponding flow rate or an associated opening position/cross-sectional area of the orifice 120.

Moreover, at (220), the control logic 200 includes determining an opening position of the adjustable orifice of the first or second flow control valve corresponding to the other of the first or second hydraulic loads based on the determined difference, a selected pressure drop, and the determined flow rate. Specifically, in several embodiments, the computing system 148 may determine the opening position for the adjustable orifice 116, 120 of the first or second flow control valve 114, 118 corresponding to the lift cylinders 36 or the tilt cylinders 38 having the lower pressure therein based on the difference determined at (216), the flow rate determined at (218), and/or a selected or ideal pressure drop across the valve 114, 118 corresponding to the lift cylinders 36 or the tilt cylinders 38 having the greater hydraulic fluid pressure (which may be a predetermined value stored in the memory 154). For example, when it is determined at (206) that the lift cylinders 38 are associated with the greater hydraulic pressure, the computing system 148 determines the opening position for the adjustable orifice 120 of the second flow control valve 116 based on the difference determined at (216), the flow rate determined at (218), and/or a selected pressure drop across the first flow control valve 114. Specifically, in such instances, the computing system 148 may access an inverse valve area map stored within its memory 154 for the second flow control valve 118. The inverse valve area map may, in turn, be a look-up table or other suitable data structure that correlates the difference determined at (216), the flow rate determined at (218), and/or the selected/ideal pressure drop across the first flow control valve 114 to an associated opening position/cross-sectional area of the orifice 120.

In addition, at (222), the control logic 200 includes controlling the operation of the first or second flow control valve corresponding to the other of the first or second hydraulic loads such that the corresponding adjustable orifice is moved to the determined opening position. Specifically, in several embodiments, the computing system 148 may control the operation of the first or second flow control valve 114, 118 corresponding to the lift cylinders 36 or the tilt cylinders 38 having the lower hydraulic fluid pressure such that the corresponding adjustable orifice 116, 120 is moved to the opening position determined at (220). For example, when it is determined at (206) that the lift cylinders 38 are associated with the greater hydraulic pressure, the computing system 148 controls the operation of the second flow control valve 118 such that its adjustable orifice is moved to the opening position determined at (220). Specifically, in such instances, the computing system 148 may transmit control signals to the second flow control valve 118 via the communicative link 150 instructing the valve 118 to move its orifice 120 to the opening position determined at (220). Thus, the orifice opening position of the flow control valve 114, 118 corresponding to the hydraulic load associated with the lower hydraulic fluid pressure is controlled based on the corresponding received input and the pressure of the hydraulic fluid being supplied to that load.

The execution of the control logic 200 improves the operation of the work vehicle 10. More specifically, as described above, when executing the control logic 200, the flow control valve 114, 118 corresponding to the hydraulic load (e.g., the lift cylinders 36 or the tilt cylinders 38) having the greater fluid pressure is controlled such that its orifice 116, 120 is opened to the maximum flow position. Additionally, the other flow control valve 114, 118 is controlled based on the corresponding input received at (202) or (204) and the pressures of the fluid being supplied the first and second hydraulic loads. This allows the flow control valves 114, 118 to supply the desired flow of hydraulic fluid to each hydraulic load, while minimizing the pressure of the hydraulic fluid being discharged by the pump 102 and without the need for compensator valves. Thus, the control logic 200 allows for the removal of the compensator valves from the work vehicle 10 in which its pump 102 is controlled via the electronically controlled actuator 130, thereby reducing the load on the pump 102 and improving the efficiency and fuel economy of the vehicle 10.

Figure 4:
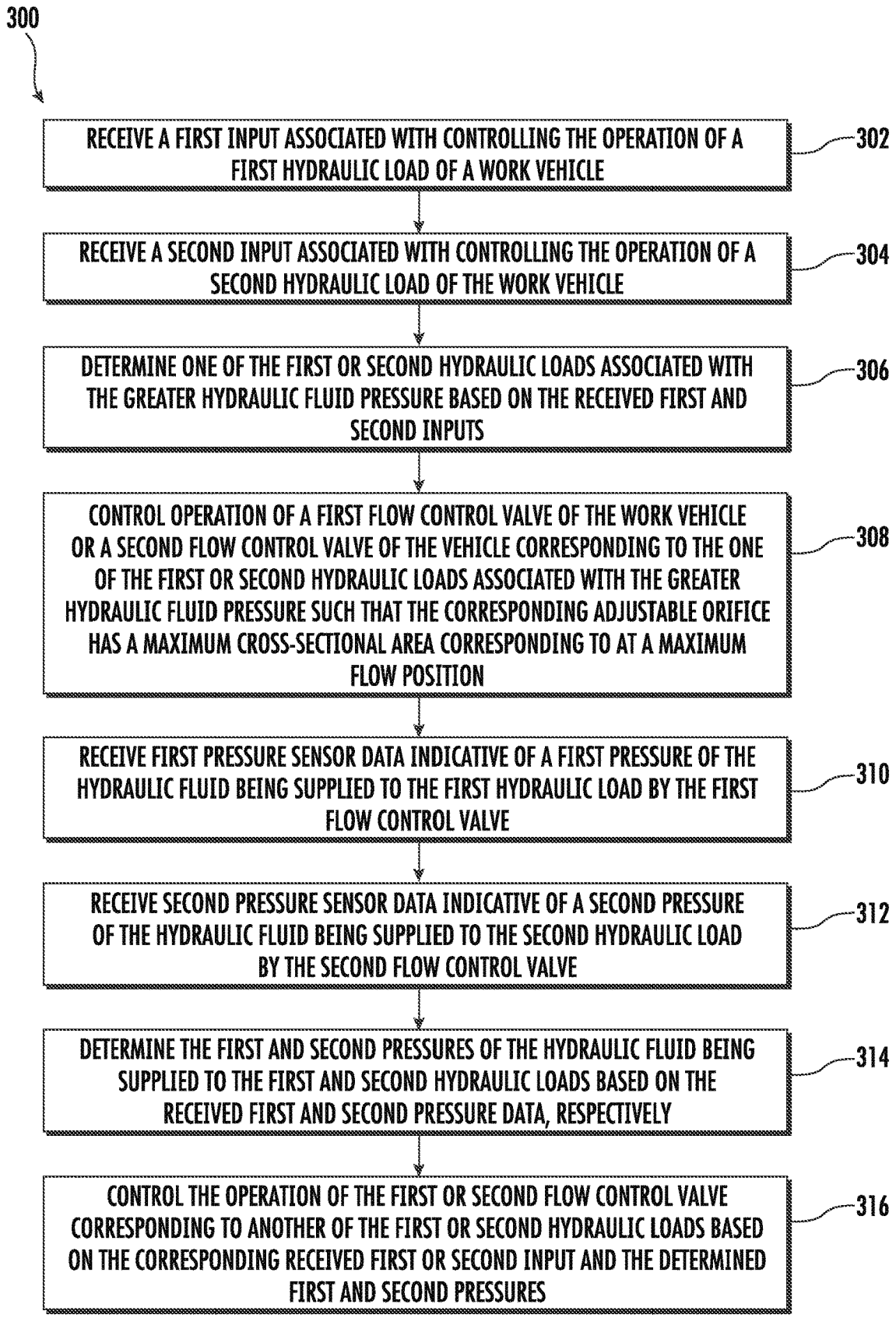
FIG. 4 illustrates a flow diagram of one embodiment of a method for controlling hydraulic valve operation within a work vehicle in accordance with aspects of the present subject matter.

Referring now to FIG. 4, a flow diagram of one embodiment of a method 300 for controlling hydraulic valve operation within a work vehicle is illustrated in accordance with aspects of the present subject matter. In general, the method 300 will be described herein with reference to the work vehicle 10 and the system 100 described above with reference to FIGS. 1-3. However, it should be appreciated by those of ordinary skill in the art that the disclosed method 300 may generally be implemented with any work vehicle having any suitable vehicle configuration and/or within any system having any suitable system configuration. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 4, at (302), the method 300 may include receiving, with a computing system, a first input associated with controlling the operation of a first hydraulic load of a work vehicle. For instance, as described above, the computing system 148 may be configured to receive a first input (e.g., a first operator input) from the user interface 155 via the communicative link 150. The first input may, in turn, be associated with controlling the operation of a first hydraulic load (e.g., the lift cylinders 36).

Furthermore, at (304), the method 300 may include receiving, with the computing system, a second input associated with controlling the operation of a second hydraulic load of the work vehicle. For instance, as described above, the computing system 148 may be configured to receive a second input (e.g., a second operator input) from the user interface 155 via the communicative link 150. The second input may, in turn, be associated with controlling the operation of a second hydraulic load (e.g., the tilt cylinders 38).

Additionally, as shown in FIG. 4, at (306), the method 300 may include determining, with the computing system, one of the first or second hydraulic loads associated with a greater hydraulic fluid pressure based on the received first and second inputs. For instance, as described above, the computing system 148 may be configured to analyze the received first and second input to determine which of the first or second hydraulic loads (e.g., the lift cylinders 36 or the tilt cylinders 38) is associated with or will have the greater hydraulic fluid pressure.

Moreover, at (308), the method 300 may include controlling, with the computing system, the operation of the first or second flow control valve corresponding to the one of the first or second hydraulic loads associated with the greater hydraulic fluid pressure such that the corresponding adjustable orifice has a maximum cross-sectional area corresponding to at a maximum flow position. For instance, as described above, the computing system 148 may be configured to control the operation of the first or second flow control valve 114, 118 corresponding to the hydraulic load (e.g., the lift cylinders 36 or the tilt cylinders 38) associated with the greater hydraulic fluid pressure such that its adjustable orifice 116, 120 is moved to its maximum flow position (i.e., has its maximum cross-sectional area).

In addition, as shown in FIG. 4, at (310), the method 300 may include receiving, with the computing system, first pressure sensor data indicative of a first pressure of the hydraulic fluid being supplied to the first hydraulic load by the first flow control valve. For instance, as described above, the computing system 148 may be configured to receive first pressure sensor data from the first pressure sensor 156 via the communicative link 150. The first pressure data is, in turn, indicative of the pressure of the hydraulic fluid being supplied to the first hydraulic load (e.g., the lift cylinders 36) by the first flow control valve 114.

Furthermore, at (312), the method 300 may include receiving, with the computing system, second pressure sensor data indicative of a second pressure of the hydraulic fluid being supplied to the second hydraulic load by the second flow control valve. For instance, as described above, the computing system 148 may be configured to receive second pressure sensor data from the second pressure sensor 158 via the communicative link 150. The second pressure data is, in turn, indicative of the pressure of the hydraulic fluid being supplied to the second hydraulic load (e.g., the tilt cylinders 38) by the second flow control valve 118.

Additionally, as shown in FIG. 4, at (314), the method 300 may include determining, with the computing system, the first and second pressures of the hydraulic fluid being supplied to the first or second hydraulic loads based on the corresponding received first or second pressure data, respectively. For instance, as described above, the computing system 148 may be configured to determine the pressure of the hydraulic fluid being supplied to the first or second hydraulic loads (e.g., the lift cylinders 36 or the tilt cylinders 38) based on the first or second pressure data, respectively.

Moreover, at (316), the method 300 may include controlling, with the computing system, the operation of the first or second flow control valve corresponding to another of the first or second hydraulic loads based on the corresponding received first or second input and the determined first and second pressures. For instance, as described above, the computing system 148 may be configured to control the operation of the first or second flow control valve 114, 118 corresponding to the other hydraulic load (e.g., the lift cylinders 36 or the tilt cylinders 38 associated with the lower hydraulic fluid pressure) based on both the corresponding first or second input and the determined first and second pressures.

It is to be understood that the steps of the control logic 200 and the method 300 are performed by the computing system 148 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the computing system 148 described herein, such as the control logic 200 and the method 300, is implemented in software code or instructions which are tangibly stored on a tangible computer readable medium. The computing system 148 loads the software code or instructions via a direct interface with the computer readable medium or via a wired and/or wireless network. Upon loading and executing such software code or instructions by the computing system 148, the computing system 148 may perform any of the functionality of the computing system 148 described herein, including any steps of the control logic 200 and the method 300 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A work vehicle, comprising:

a first hydraulic load;

a second hydraulic load in parallel with the first hydraulic load;

a pump configured to supply hydraulic fluid to the first and second hydraulic loads via first and second fluid conduits, respectively;

a first flow control valve defining an adjustable orifice, the first flow control valve fluidly coupled to the first fluid conduit upstream of the first hydraulic load such that the first flow control valve is configured to control a flow rate of the hydraulic fluid to the first hydraulic load;

a second flow control valve defining an adjustable orifice, the second flow control valve fluidly coupled to the second fluid conduit upstream of the second hydraulic load such that the second flow control valve is configured to control a flow rate of the hydraulic fluid to the second hydraulic load;

a first pressure sensor configured to capture data indicative of a first pressure of the hydraulic fluid being supplied to the first hydraulic load by the first flow control valve;

a second pressure sensor configured to capture data indicative of a second pressure of the hydraulic fluid being supplied to the second hydraulic load by the second flow control valve; and a computing system communicatively coupled to the first and second pressure sensors, the computing system configured to:

receive a first input associated with controlling an operation of the first hydraulic load;

receive a second input associated with controlling an operation of the hydraulic fluid to be supplied to the second hydraulic load;

determine one of the first or second hydraulic loads associated with a greater hydraulic fluid pressure based on the received first and second inputs;

control an operation of the first or second flow control valve corresponding to the one of the first or second hydraulic loads associated with the greater hydraulic fluid pressure such that the corresponding adjustable orifice has a maximum cross-sectional area corresponding to a maximum flow position;

determine the first and second pressures of the hydraulic fluid being supplied to the first or second hydraulic loads based on the data captured by the first and second pressure sensors, respectively; and control an operation of the first or second flow control valve corresponding to another of the first or second hydraulic loads based on the corresponding received first or second input and the determined first and second pressures.

2. The work vehicle of claim 1, further comprising:

an electronically controlled actuator configured to control an operation of the pump.

3. The work vehicle of claim 2, wherein the computing system is communicatively coupled to the electronically controlled actuator, the computing system further configured to control the operation of the pump based on a greater of the determined first or second pressures.

4. The work vehicle of claim 1, further comprising:

a third pressure sensor configured to capture data indicative of a third pressure of the hydraulic fluid being supplied to the first and second fluid conduits by the pump, wherein the computing system is further configured to:

determine the third pressure based on the data captured by the third pressure sensor; and control the operation of the first or second flow control valve corresponding to the other of the first or second hydraulic loads based on the determined third pressure, the received second input, and the determined first and second pressures.

5. The work vehicle of claim 4, wherein the computing system is further configured to control the operation of the first or second flow control valve corresponding to the other of the first or second hydraulic loads based on a selected pressure drop across the first or second flow control valve corresponding to the one of the first or second hydraulic loads associated with the greater of the first or second pressures, the received second input, and the determined first, second, and third pressures.

6. A system for controlling hydraulic valve operation within a work vehicle, comprising:

a first hydraulic load;

a second hydraulic load in parallel with the first hydraulic load;

a pump configured to supply hydraulic fluid to the first and second hydraulic loads via first and second fluid conduits, respectively;

a first flow control valve defining an adjustable orifice, the first flow control valve fluidly coupled to the first fluid conduit upstream of the first hydraulic load such that the first flow control valve is configured to control a flow rate of the hydraulic fluid to the first hydraulic load;

a second flow control valve defining an adjustable orifice, the second flow control valve fluidly coupled to the second fluid conduit upstream of the second hydraulic load such that the second flow control valve is configured to control a flow rate of the hydraulic fluid to the second hydraulic load;

a first pressure sensor configured to capture data indicative of a first pressure of the hydraulic fluid being supplied to the first hydraulic load by the first flow control valve;

a second pressure sensor configured to capture data indicative of a second pressure of the hydraulic fluid being supplied to the second hydraulic load by the second flow control valve; and a computing system communicatively coupled to the first and second pressure sensors, the computing system configured to:

receive a first input associated with controlling the operation of the first hydraulic load;

receive a second input associated with controlling the operation of the second hydraulic load;

determine one of the first or second hydraulic loads associated with a greater hydraulic fluid pressure based on the received first and second inputs;

control an operation of the first or second flow control valve corresponding to the one of the first or second hydraulic loads associated with the greater hydraulic fluid pressure such that the corresponding adjustable orifice has a maximum cross-sectional area corresponding to a maximum flow position;

determine the first and second pressures of the hydraulic fluid being supplied to the first or second hydraulic loads based on the data captured by the first and second pressure sensors, respectively; and control an operation of the first or second flow control valve corresponding to another of the first or second hydraulic loads based on the corresponding received first or second input and the determined first and second pressures.

7. The system of claim 6, further comprising:

an electronically controlled actuator configured to control an operation of the pump.

8. The system of claim 7, wherein the computing system is communicatively coupled to the electronically controlled actuator, the computing system further configured to control the operation of the pump based on a greater of the determined first or second pressures.

9. The system of claim 6, further comprising:

a third pressure sensor configured to capture data indicative of a third pressure of the hydraulic fluid being supplied to the first and second fluid conduits by the pump, wherein the computing system is further configured to:

determine the third pressure based on the data captured by the third pressure sensor; and control the operation of the first or second flow control valve corresponding to the other of the first or second hydraulic loads based on the determined third pressure, the received second input, and the determined first and second pressures.

10. The system of claim 9, wherein the computing system is further configured to control the operation of the first or second flow control valve corresponding to the other of the first or second hydraulic loads based on a selected pressure drop across the first or second flow control valves corresponding to the one of the first or second hydraulic loads associated with a greater of the first or second pressures, the received second input, and the determined first, second, and third pressures.

11. The system of claim 10, wherein, when controlling the operation of the first or second flow control valve corresponding to the other of the first or second hydraulic loads, the computing system is further configured to determine a difference between the determined third pressure and a greater of the determined first or second pressures.

12. The system of claim 11, wherein, when controlling the operation of the first or second flow control valve corresponding to the other of the first or second hydraulic loads, the computing system is further configured to determine a flow rate of hydraulic fluid to be supplied to the other of the first or second hydraulic loads based on the corresponding received first or second input.

13. The system of claim 12, wherein, when controlling the operation of the first or second flow control valve corresponding to the other of the first or second hydraulic loads, the computing system is further configured to determine an opening position of the adjustable orifice of the first or second flow control valve corresponding to the other of the first or second hydraulic loads based on the determined difference, the selected pressure drop, and the determined flow rate.

14. The system of claim 13, wherein, when controlling the operation of the first or second flow control valve corresponding to the other of the first or second hydraulic loads, the computing system is further configured to control the operation of the first or second flow control valve corresponding to the other of the first or second hydraulic loads such that the corresponding adjustable orifice is moved to the determined opening position.

15. A method for controlling hydraulic valve operation within a work vehicle, the work vehicle including first and second hydraulic loads in parallel, a pump configured to supply hydraulic fluid to the first and second hydraulic loads, respectively, the work vehicle further including a first flow control valve configured to control a flow rate of the hydraulic fluid to the first hydraulic load and a second flow control valve configured to control a flow rate of the hydraulic fluid to the second hydraulic load, the method comprising:

receiving, with a computing system, a first input associated with controlling an operation of the first hydraulic load;

receiving, with the computing system, a second input associated with controlling an operation of the second hydraulic load;

determining, with the computing system, one of the first or second hydraulic loads associated with a greater hydraulic fluid pressure based on the received first and second inputs;

controlling, with the computing system, an operation of the first or second flow control valve corresponding to the one of the first or second hydraulic loads associated with the greater hydraulic fluid pressure such that the corresponding adjustable orifice has a maximum cross-sectional area corresponding to a maximum flow position;

receiving, with the computing system, first pressure sensor data indicative of a first pressure of the hydraulic fluid being supplied to the first hydraulic load by the first flow control valve;

receiving, with the computing system, second pressure sensor data indicative of a second pressure of the hydraulic fluid being supplied to the second hydraulic load by the second flow control valve;

determining, with the computing system, the first and second pressures of the hydraulic fluid being supplied to the first or second hydraulic loads based on the received first and second pressure sensor data, respectively; and controlling, with the computing system, an operation of the first or second flow control valve corresponding to another of the first or second hydraulic loads based on the corresponding received first or second input and the determined first and second pressures.

16. The method of claim 15, wherein the work vehicle further includes an electronically controlled actuator configured to control an operation of the pump, the method further comprising:

controlling, with the computing system, an operation of the pump based on a greater of the determined first or second pressures.

17. The method of claim 15, further comprising:

receiving, with the computing system, third pressure sensor data indicative of a third pressure of the hydraulic fluid being supplied to the first and second fluid conduits by the pump; and determining, with the computing system, the third pressure based on the data received third pressure sensor data, wherein controlling the operation control the operation of the first or second flow control valve corresponding to the other of the first or second hydraulic loads comprises controlling, with the computing system, the operation of the first or second flow control valve corresponding to the other of the first or second hydraulic loads based on the determined third pressure, the corresponding received first or second input, and the determined first and second pressures.

18. The method of claim 17, wherein controlling the operation of the first or second flow control valve corresponding to the other of the first or second hydraulic loads comprises controlling, with the computing system, the operation of the other of the first or second flow control valves based on a selected pressure drop across the first or second flow control valve corresponding to the one of the first or second hydraulic loads associated with the greater hydraulic fluid pressure, the corresponding received first or second input, the determined first, second, and the third pressures.

19. The method of claim 18, wherein controlling the operation of the first or second flow control valve corresponding to the other of the first or second hydraulic loads comprises determining, with the computing system, a difference between the determined third pressure and a greater of the determined first or second pressures.

20. The method of claim 19, wherein controlling the operation of the first or second flow control valve corresponding to the other of the first or second hydraulic loads comprises determining, with the computing system, a flow rate of hydraulic fluid to be supplied to the other of the first or second hydraulic loads based on the corresponding received first or second input.

* * * * *